US008978942B2

(12) United States Patent
Bell

(10) Patent No.: US 8,978,942 B2
(45) Date of Patent: Mar. 17, 2015

(54) QUICK RELEASE WATCH BAND

(76) Inventor: Brian K. Bell, Lafayette, IN (US)

( * ) Notice: Subject to any disclaimer, the term of this patent is extended or adjusted under 35 U.S.C. 154(b) by 949 days.

(21) Appl. No.: 12/943,473

(22) Filed: Nov. 10, 2010

(65) Prior Publication Data

US 2012/0111905 A1 May 10, 2012

(51) Int. Cl.
*A44C 5/14* (2006.01)
*A44B 11/24* (2006.01)

(52) U.S. Cl.
CPC .. *A44B 11/24* (2013.01); *A44C 5/14* (2013.01)
USPC ..... 224/177; 24/265 WS

(58) Field of Classification Search
USPC ..... 224/177; 24/265 WS, 265 B
See application file for complete search history.

(56) References Cited

U.S. PATENT DOCUMENTS 2,916,791 A * 12/1959 Guarnieri ..... 24/265 B
2,932,074 A 4/1960 Resnick
3,994,265 A * 11/1976 Banks ..... 119/865
4,044,725 A 8/1977 Miller
4,180,016 A 12/1979 George
4,564,308 A 1/1986 Ikegami et al.
4,782,425 A * 11/1988 Breidegam ..... 361/212
4,785,982 A * 11/1988 Iwamura et al. ..... 224/177
4,805,271 A 2/1989 Ripley
D322,871 S 12/1991 Heyman et al.
5,408,220 A * 4/1995 Brown et al. ..... 340/571
5,443,039 A 8/1995 Suchowski
6,014,793 A 1/2000 Howald
6,487,761 B2 * 12/2002 Van Tassel ..... 24/606
7,070,322 B1 7/2006 Field et al.
7,380,979 B2 6/2008 Hiranuma et al.
7,441,946 B2 * 10/2008 Bonadei ..... 368/282
7,854,045 B2 12/2010 Bell
8,196,273 B2 * 6/2012 Anscher ..... 24/606
8,522,410 B2 * 9/2013 Parisi et al. ..... 24/634
2008/0092344 A1 * 4/2008 Bell ..... 24/265 B

* cited by examiner

*Primary Examiner* — J. Gregory Pickett
*Assistant Examiner* — John Cogill
(74) *Attorney, Agent, or Firm* — Barnes & Thornburg LLP

(57) ABSTRACT

A wristband assembly comprises a first portion having a first length, a second portion having a second length, and a release mechanism. The release mechanism is configured to establish a pre-defined pre-load that corresponds to the magnitude of tension load at which the first portion is released from the second portion.

16 Claims, 4 Drawing Sheets

QUICK RELEASE WATCH BAND

BACKGROUND

The current disclosure relates to jewelry bands. More specifically, the current disclosure relates to jewelry bands, such as watch bands, for example, which have a quick release feature which causes the band to release if excessive force is applied to the watch band.

Jewelry bands in general and watch bands specifically are prone to catching or snagging on furniture or equipment when the band is worn by an active individual. If the band catches on an object, a wearer is susceptible to injury by the band.

SUMMARY

The present application discloses one or more of the features recited in the appended claims and/or the following features which, alone or in any combination, may comprise patentable subject matter:

According to one aspect of the present disclosure, a wristband assembly comprises a first portion having a first length, a second portion having a second length, and a release mechanism. The first and second portions cooperate to define a longitudinal axis along the first and second length. The longitudinal axis corresponds to a direction in which a tension load is applied when the wristband is secured to a user. The release mechanism couples the first portion to the second portion. The release mechanism includes a rod engaged with the first portion and at least one post secured to the second portion. The post is frictionally engaged with the rod to establish a pre-defined pre-load that corresponds to the magnitude of tension load at which the first portion is released from the second portion.

In some embodiments, the post of the release mechanism is secured to the first portion through a threaded connection between the post and the first portion. The post may be adjustable relative to the first portion to vary the magnitude of the frictional engagement between the posts and the rod, to thereby vary the pre-load. In some embodiments, the release assembly comprises two posts. When the release mechanism comprises two posts, the posts of the release mechanism may both be secured to the first portion through a threaded connection between each post and the first portion. Each post may be adjustable relative to the first portion to vary the magnitude of the frictional engagement between the posts and the rod, to thereby vary the pre-load.

In some embodiments, the wristband may comprise a buckle having a tang that deflects under load. The buckle may also further comprise an axle about which the tang rotates, a crossbar that engages the tang when the buckle is in use, the tang deflecting sufficiently to slip past the crossbar when the tension load exceeds a pre-defined value. The tang may comprise nylon.

In other embodiments, the buckle may further comprise a first crossbar about which the tang rotates, a second crossbar that engages the tang when the buckle is in use, the first crossbar and the tang deflecting sufficiently to cause the tang slip past the second crossbar when the tension load exceeds a pre-defined value.

In some embodiments, the buckle may be positionable at a plurality of positions along the length of the first portion of the wristband assembly.

In another aspect of the present disclosure a wristband assembly comprises a first strap having a first length, a second strap adjacent the first strap, the second strap having a second length, and a release mechanism. The first and second straps cooperate to define a longitudinal axis along the first and second lengths, the longitudinal axis corresponding to a direction in which a tension load is applied when the wristband is secured to a user. The release mechanism couples at least one of the first and second straps to a first portion of the wristband assembly. The release mechanism includes a rod engaged with the at least one of the first and second straps and at least one post secured to the first portion. The post is frictionally engaged with the rod to establish a pre-defined pre-load that corresponds to the magnitude of tension load at which the first portion is released from the at least one of the first and second straps.

The post of the release mechanism may be secured to the first portion through a threaded connection between the post and the first portion. The post may be adjustable relative to the first portion to vary the magnitude of the frictional engagement between the posts and the rod, to thereby vary the pre-load.

The first and second straps may be coupled by a buckle including an axle, about which the tang rotates, a crossbar that engages the tang when the buckle is in use, the tang deflecting sufficiently to slip past the crossbar when the tension load exceeds a pre-defined value.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
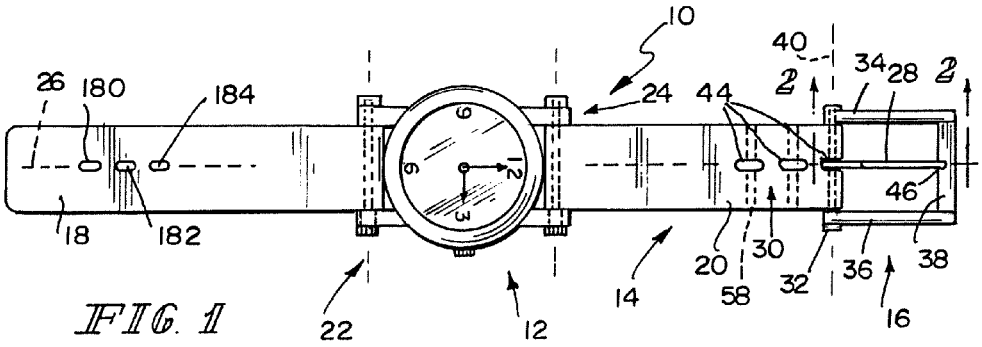
FIG. 1 is a plan view of a wrist-watch assembly including a watch body, a band, and a clasp.

According to the present disclosure a wristwatch assembly 10 includes a watch body 12, a wristband assembly 14, and a buckle 16 as shown in FIG. 1. The wristband assembly 14 includes a first strap 18 and a second strap 20, each of the straps 18, 20 secured to the watch body 12. The wristwatch assembly 10 of FIG. 1 is includes a number of independent structures each of which may be present in a single wristwatch assembly, or may be applied individually to other embodiments of wristwatch assemblies.

The straps 18, 20 of the wristband assembly 14 are each coupled to the watch body 12 via respective release mechanisms 22, 24. The release mechanisms 22, 24 provide an assembly which allows the wristband assembly 14 to be quickly decoupled from the watch body 12 if sufficient force is applied to the wristwatch assembly 10 along an axis 26.

The buckle 16 of wristwatch assembly 10 also includes a quick release feature is accomplished through the use of a spring-loaded tang 28 that allows the buckle 16 to disengage from the strap 18 is sufficient force is applied to the wristwatch assembly 10 along the axis 26. The quick release feature of the buckle 16 is redundant to the release mechanisms 22, 24 with each serving a similar purpose, namely, permitting decoupling of portions of the wristwatch assembly 10 if an excessive load is applied to the wristband assembly 14. These features are especially useful in situations where the wristwatch assembly 10 is used in an environment where portions of the wristwatch assembly 10 may become entangled on machinery or caught on structures while a user is being active. For example, in industrial settings a user may wear a wristwatch assembly 10 while working around moving machinery. The quick release features disclosed herein reduce the likelihood that a wristwatch assembly 10 which is snagged on a piece of equipment or structural will remain attached to the wearer. This reduces the opportunity for injury to the wearer.

Still another feature which will be discussed in more detail below is a buckle positioner 30 which permits a user to modify the wristwatch assembly 10 to optimize the fit of the wristband assembly 14. By properly adjusting the wristband assembly 14 to fit the user, the force required along the axis 26 to cause the tang 28 to release or to cause the release mechanisms 22, 24 to release is more consistent from user to user, thereby providing consistent performance of the wristwatch assembly 10.

Figure 2:
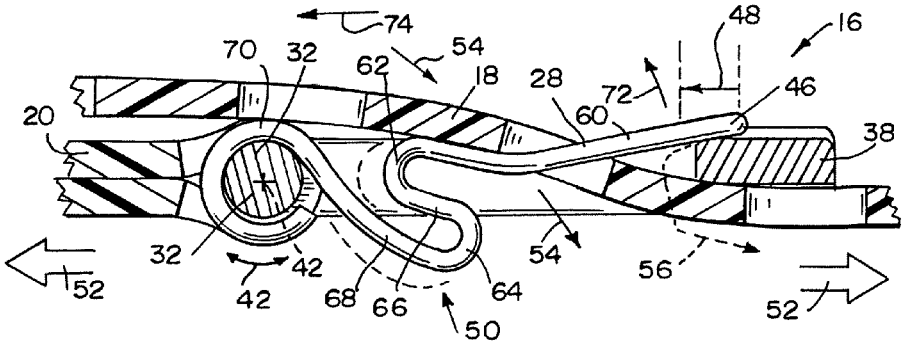
FIG. 2 is a side view with portions removed of an embodiment of a clasp assembly for use with a wrist band.

In a first embodiment, the buckle 16 includes an axle 32, two side arms 34, 36 coupled to the axle 32 coupled to the axle 32, and a crossbar 38 coupled to the side arms 34, 36 as shown in FIG. 1. A tang 28 of buckle 16 is supported on the axle 32 and movable relative to the axle 32 about an axis 40. Referring now to FIG. 2, the tang 28 rotates about the axis 40 as indicated by the arrow 42. The tang 28 is positioned in one of several holes 44 formed in the strap 20. The strap 20 underlies the crossbar 38 with an end 46 of the tang 28 engaged with the crossbar 38 over a distance 48. Tension 52 on the wristband assembly 14 causes a force 54 to be developed such that the tang 28 urged against the crossbar 38. The crossbar 38 reacts to the force 54 that the tension 52 is resisted by the action of the end 46 of the tang 28 acting on the crossbar 38. When the tension 52 becomes large enough, the resulting force 54 pushes the tang 28 such that the tang 28 deflects and releases the strap 18.

In the illustrative embodiment of FIG. 2, the tang 28 includes a spring portion 50 which deflects under load will deflect thereby allowing the end 46 of the tang 28 to slip past the crossbar 38 and thereby allow the buckle 16 to release from the strap 18. The deflection of the spring portion 50 of the tang 28 is indicated by the phantom line on FIG. 2. Various factors affect the tension 52 required to cause the spring portion 50 to deflect sufficiently to allow the end 46 to move over the length 48 and slip below the crossbar 38 as indicated by the dotted arrow 56 in FIG. 2. For example, the spring rate of the spring portion 50 may be controlled to control the tension 52 required. In addition, the position on the spring portion 50 where the strap 18 engages the spring portion 50 also changes the force required for disengagement. In the illustrative embodiment, a tension force 52 that is equal to 3 pounds acting parallel to the axis 26 is sufficient to cause the tang 28 to deflect sufficiently to slip past the crossbar 38.

The tang 28 includes an arm 60, which extends from the spring portion 50 and engages the crossbar 38. The spring portion 50 includes a first bend 62 interconnecting the arm 60 and a strut 66. A second bend 64 is connected to the strut 66 and an arm 68. A loop 70 is connected to the arm 68 and secures the tang 28 to the axle 32. Deflection of the tang 28 in the direction of arrow 72 occurs when the bend 62 and bend 64 deflect to open. However, bend 64 acts as a fulcrum for bend 62 when the arm 60 deflects in the direction 72 such that bend 62 tends to move in the direction of arrow 74, thereby causing the end 46 to slide relative to the crossbar 38.

Figure 3:
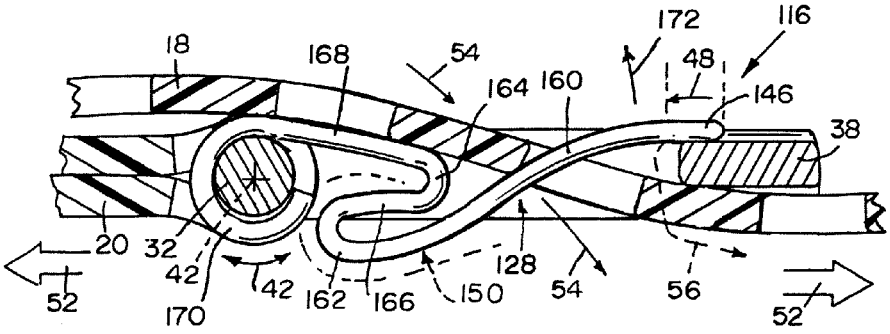
FIG. 3 is a side view with portions removed of another embodiment of a clasp assembly for use with a wrist band.

In another embodiment of a buckle 116 shown in FIG. 3, a tang 128 of the buckle 116 includes a spring portion 150 with a first arm 160 coupled to a bend 162 of the spring portion 150. The bend 162 is coupled to a strut 166 which is coupled to a second bend 164. The bend 164 is coupled to a second arm 168 which is coupled to a loop 170 that secures the tang 128 to the axle 32. Deflection of the tang 128 in the direction of arrow 172 results when the bend 162 collapses and the bend 164 opens. Bend 164 acts as a fulcrum and the deflection of bend 164 causes bend 162 and arm 160 to move in the direction of arrow 174, thereby increasing the distance 48. In some embodiments, this action assists with preventing false releasing of the tang 128 as compared to tang 28.

Figure 7:
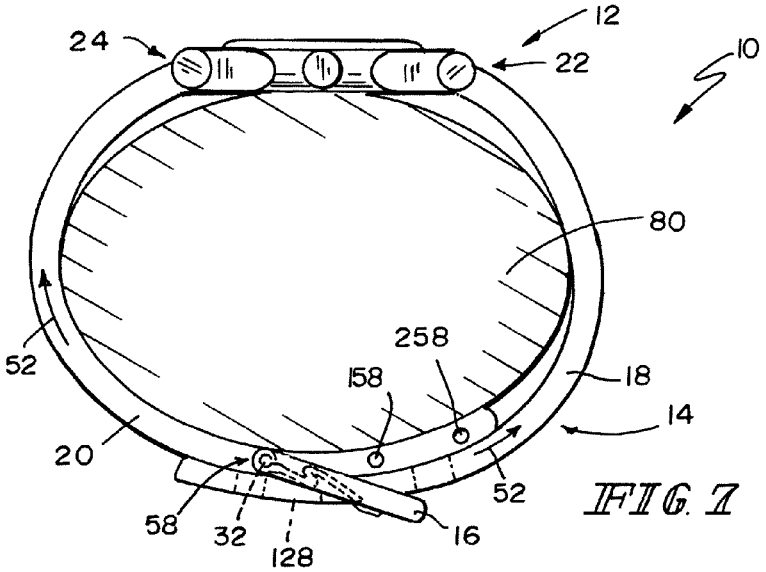
FIG. 7 is a perspective view of a wrist-watch assembly including the strap of FIG. 6, the wrist-watch supported on a wrist.

The embodiment of tang 128 is shown in FIG. 7 with the wristwatch assembly 10 on the wrist of a user 80. The tension 52 at the buckle 16 is developed in both strap 18 and strap 20 when the wristband assembly 14 is snagged on a piece of equipment or other obstruction. While shown as two arrows 52 on either side of buckle 16, it should be understood that the tensile force is developed throughout the wristwatch assembly 10 and that separation of any two components of the wristwatch assembly 10 will release the wristwatch assembly 10 from the user 80.

Figure 4:
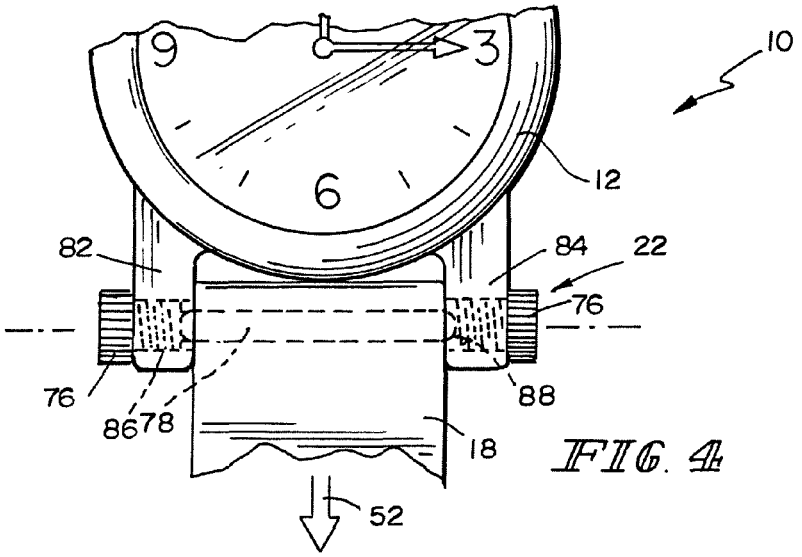
FIG. 4 is a partial plan view of a wrist watch with a quick release retainer assembly securing a wrist band to a watch body.
Figure 5:
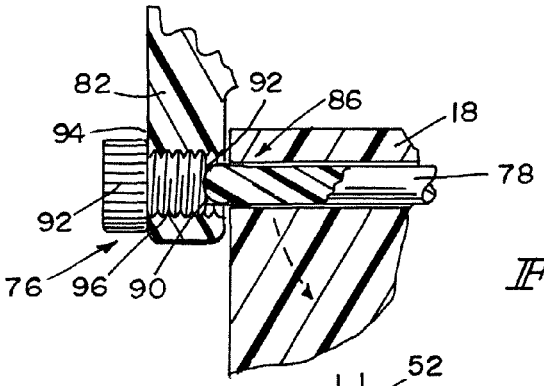
FIG. 5 is a cross-sectional view of a portion of the wrist watch of FIG. 4.

Referring now to FIGS. 4 and 5, the release mechanism 22 is shown to include a pair of posts 76, 76 which are threaded into two arms 82 and 84 of the watch body 12. The posts 76, 76 engage a rod 78 that extends through the strap 18 with each end 86, 88 of the rod 78 engaging each of the posts 76, 76 in a friction connection to retain the strap 18 to the watch body 12. Referring now to FIG. 5, end 86 of rod 78 is shown to have a rounded surface 90 that engages concave surface 92 of the post 76. The post 76 includes a knurled head 92 and a threaded body 94 that is received in a threaded cavity 96 of the arm 82 of the watch body 12. When both posts 76 are installed, the rod 78 is captured between the posts 76, 76 under a compressive force. Each end 86, 88 of the rod 78 engages the respective post 76, 76 in a similar manner so that the rounded surface 90 on each end 86, 88 of the rod 78 engages a respective surface 92 of each post 76. When tension 52 is applied to the strap 18 in the direction of the axis 26, the frictional interaction between the posts 76, 76 and the rod 78 retain the strap 18 coupled to the watch body 12 until sufficient force is developed to overcome the frictional resistance and cause the rod 78 to deflect to release the strap 18 from the watch body 12. The rod 78 comprises nylon which deforms under load. It should be understood that the rod 78 may comprise other pliable materials which are deformable under load.

Once the strap 18 is released from the watch body 12, the posts 76 may be retracted by unscrewing the posts 76, 76 from the arms 82 and 84. The wristband assembly 14 may be re-coupled to the watch body 12 so that the wristwatch assembly 10 may be re-used. It will be appreciated that the ability to re-assemble the wristband assembly 14 allows the wristwatch assembly 10 to be re-used after multiple releases with a relatively simple assembly process. Thus, the wristwatch assembly 10 is reusable after each release. It should also be understood that the tension 52 required to cause the release mechanism 22 to release the strap 18 from the watch body 12 may be adjusted by varying the depth the posts 76, 76 are screwed into the arms 82, 84. A change in depth results in a change in the pre-load applied to the rod 78 and thereby reduces the frictional interaction between the posts 76, 76 and the rod 78. With a lower pre-load, the release mechanism 22 will release under at a lower tension 52.

Figure 9:
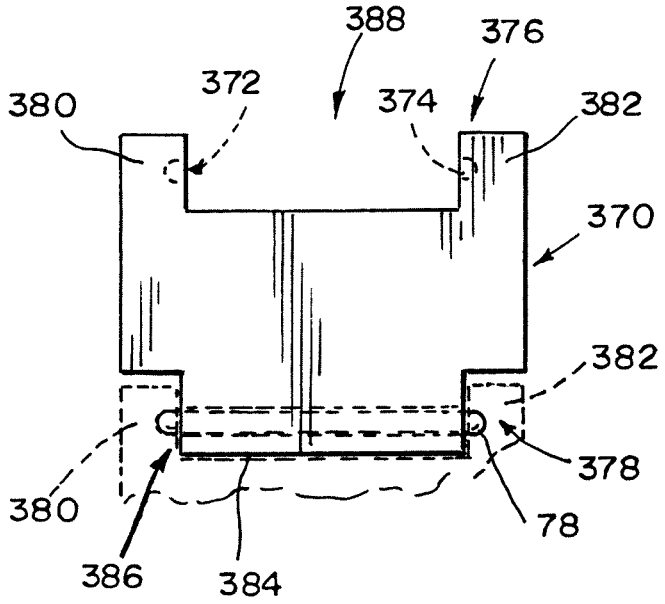

Referring now to FIG. 9, a link 370 that makes up part of a wristband includes a first end 376 and a second end 378. The first end 376 includes two arms 380 and 382. The arms 380 and 382 are each formed to include a respective hemispherical cavity 372, 374. An extension 384 of link 370 is sized to be received in a space 388 between the arms 380 and 382 of an adjacent link 370. A through-hole 386 formed in the extension 384 is sized to receive a rod 78 therethrough with the ends of the rod 78 being received in the cavities 372 and 374. Because the rod 78 is pliable, the rod 78 may be forced into the cavities 372 and 374 to couple adjacent links 370, 370. With pre-determined clearance between the rod 78 and cavities 372, 374, the tension 54 necessary to cause the links 370, 370 to separate can be established within an acceptable repeatability.

It should be understood that the arms 380 and 382 of link 370 may be replaced by the arms 82 and 84 of the watch body 12 so that the link 370 includes the release mechanism 22. Thus, the link 370 may include have a predefined tension at which it releases when the embodiment of FIG. 9 is used, or it may be adjustable to release at different magnitudes of tension 54.

Figure 8:
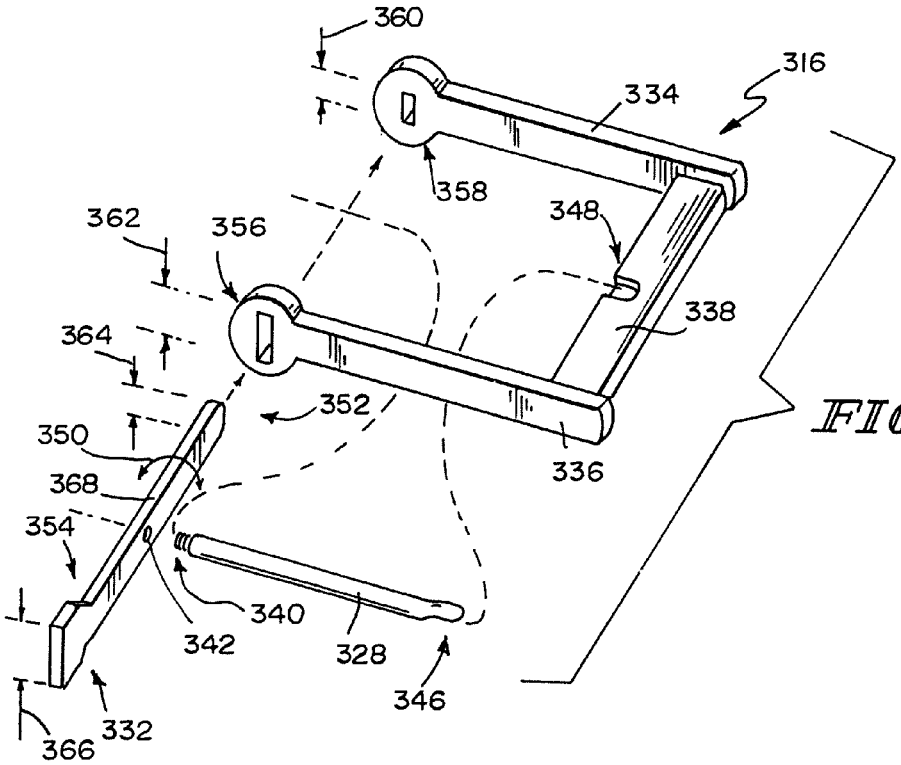
FIG. 8 is an exploded perspective view of a clasp for a wrist band.

In another embodiment shown in FIG. 8, a buckle 316 may be substituted for the buckle 16. The buckle 316 includes sidearms 334 and 336 coupled to a crossbar 338. A tang 328 of the buckle 316 includes a threaded end 340 that is received in a crossbar 332 after the crossbar 332 has been engaged with the sidearms 334 and 336. An end 346 of the tang 328 rests in a cavity 348 formed in the crossbar 338. The tang 338 and crossbar 332 each comprise nylon that deflects under a load so that a force applied to the tang 328 will cause the tang 328 to deflect and the crossbar 332 to deflect as indicated by arrow 350 such that the end 346 of the tang 328 slips past crossbar 338 and releases the tension placed on the straps the buckle 316 is connecting. The crossbar 332 includes a tapered end 352 and a tapered head 354. The tapered end 352 passes through an aperture 356 formed in sidearm 336 and is received into an aperture 358 formed in sidearm 334. When the crossbar 332 is fully installed, the tapered head 354 engages aperture 356 and the tapered end 352 engages aperture 358 so that the crossbar 332 is frictionally secured to the sidearms 334 and 336. The crossbar 332 has flexibility to allow deflection about its access as indicated by the arrow 350 when a load is applied to the tang 328. The tang 328 is fixed to the crossbar 332 by threading the end 340 into the threaded hole 342 of the crossbar 332 after the crossbar 332 is secured to the sidearms 334 and 336.

It should be noted that the height 360 of the aperture 358 is smaller than the height 364 of a body 368 of the crossbar 332 so that the tapered end 352 seats into the aperture 358. Similarly, the height 362 of the aperture 356 is smaller than the height 366 of the tapered head 354 of the crossbar 332 so that the tapered head 354 seats into the aperture 356.

It has been found that an important aspect of providing consistent release of the various components described herein is improved by assuring a proper fit of the wristband assembly 14. To that end, the strap 20 is configured to allow the buckle 16 to be positioned in multiple locations along the length of the strap 20. The strap 20 is configured with three cross-channels 58, 158, and 258 which are each sized to receive the axle 32 of the buckle 16. A separate hole 44 is positioned to engage each of the cross-channels 58, 158, 258 to allow clearance for the tang 28, 128 to move relative to the axle 32. As shown in FIG. 7, the axle 32 is positioned in the cross-channel 58 so that the tang 128 engages a hole 182 formed in strap 18 such that the engagement occurs at the bottom of the user's wrist.

Figure 6:
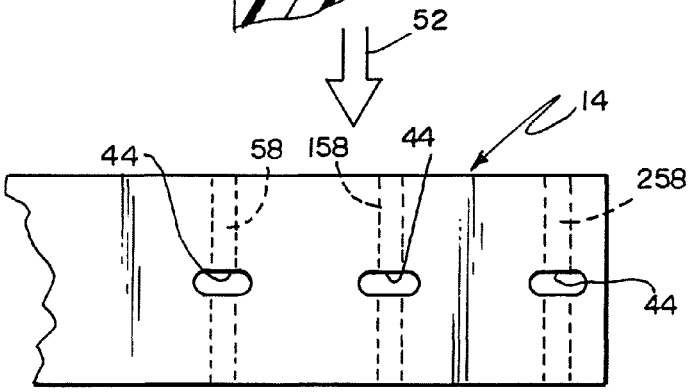
FIG. 6 is a plan view of a portion of a strap of a wrist band.

A user may adjust the position of the buckle to any one of three locations on strap 18 in the illustrative embodiment of FIGS. 6 and 7. The tang 128 may be positioned in either a hole 180, the hole 182, or a hole 184 on the strap 18 to couple the buckle 16 to strap 18. It should be understood that more holes or less holes may be formed in strap 18. Once a user has chosen a correct position for the buckle 16 on strap 20, excessive material from the strap 20 may be cut off from the strap to eliminate the overlap of strap 18 and strap 20 shown in FIG. 7.

Although certain illustrative embodiments have been described in detail above, variations and modifications exist within the scope and spirit of this disclosure as described and as defined in the following claims. For example, it should now be evident that a wristwatch assembly may include any of a number of the features disclosed herein to allow a user to adjust the fit of a wristband assembly and the tension at which various points of the wristband assembly 14 may release under a tension load. For example, in some embodiments, wristwatch assembly may include one or more release mechanisms 22 or 24, a strap 20 which permits adjustment of a buckle position, and one of the buckles 16, 116, or 316. A wristwatch assembly may also comprise one or more links 370 with a predetermined tension force at which the link 370 will release from an adjacent link 370.

The invention claimed is:

1. A wristband assembly comprising a first portion having a first length, a second portion adjacent the first portion, the second portion having a second length, the first and second portions cooperating to define a longitudinal axis along the first and second length, the longitudinal axis corresponding to a direction in which a tension load is applied when the wristband is secured to a user, a body secured to the second portion, the body including at least one arm, and a release mechanism coupling the first portion to the second portion, the release mechanism including a rod engaged with the first portion, and at least one post engaged with the arm and adjustable relative to the arm, wherein the post clamps the rod with a variable clamp force to establish a pre-defined pre-load that corresponds to the magnitude of tension load at which the first portion is released from the second portion.

2. The wristband assembly of claim 1, wherein the wristband comprises a buckle having a tang that deflects under load.

3. The wristband assembly of claim 2, wherein the buckle further comprises an axle about which the tang rotates, a crossbar that engages the tang when the buckle is in use, the tang deflecting sufficiently to slip past the crossbar when the tension load exceeds a pre-defined value.

4. The wristband assembly of claim 3, wherein the tang comprises nylon.

5. The wristband assembly of claim 4, wherein the buckle is positionable at a plurality of positions along the length of the first portion of the wristband assembly.

6. The wristband assembly of claim 2, wherein the buckle further comprises a first crossbar about which the tang rotates, a second crossbar that engages the tang when the buckle is in use, the first crossbar and the tang deflecting sufficiently to cause the tang slip past the second crossbar when the tension load exceeds a pre-defined value.

7. The wristband assembly of claim 6, wherein the tang comprises nylon.

8. The wristband assembly of claim 7, wherein the buckle is positionable at a plurality of positions along the length of the first portion of the wristband assembly.

9. The wristband assembly of claim 1, wherein the release assembly comprises two posts.

10. The wristband assembly of claim 9, wherein each of the posts of the release mechanism are secured to respective arms secured to the it second portion, the posts secured through a threaded connection between each post and the respective arm, the rod captured between the posts such that the posts cooperate to clamp the rod between the posts with a variable clamp force.

11. The wristband assembly of claim 10, wherein both the posts are adjustable relative to the first portion to vary the magnitude of the frictional engagement between the posts and the rod, to thereby vary the pre-load.

12. The wristband assembly of claim 11, wherein the wristband comprises a buckle having a tang that deflects under load.

13. The wristband assembly of claim 12, wherein the buckle further comprises an axle about which the tang rotates, a crossbar that engages the tang when the buckle is in use, the tang deflecting sufficiently to slip past the crossbar when the tension load exceeds a pre-defined value.

14. The wristband assembly of claim 13, wherein the tang comprises nylon.

15. The wristband assembly of claim 1, wherein the first portion comprises a first strap, and wherein the second portion comprises a second strap adjacent the first strap.

16. The wristband assembly of claim 15, wherein the first and second straps are coupled by a buckle including an axle about which the tang rotates, a crossbar that engages the tang when the buckle is in use, the tang deflecting sufficiently to slip past the crossbar when the tension load exceeds a pre-defined value.

* * * * *